US006863011B2

(12) United States Patent
Kinkead

(10) Patent No.: US 6,863,011 B2
(45) Date of Patent: Mar. 8, 2005

(54) PONTOON BOAT FENDER

(75) Inventor: William Alan Kinkead, Columbia, MO (US)

(73) Assignee: William A. Kinkead, Columbia, MO (US)

( * ) Notice: Subject to any disclaimer, the term of this patent is extended or adjusted under 35 U.S.C. 154(b) by 0 days.

(21) Appl. No.: 10/657,342

(22) Filed: Sep. 8, 2003

(65) Prior Publication Data

US 2004/0107887 A1 Jun. 10, 2004

Related U.S. Application Data

(63) Continuation of application No. 29/170,816, filed on Nov. 13, 2002, now Pat. No. Des. 481,665.

(51) Int. Cl.[7] ..... B63B 59/02
(52) U.S. Cl. ..... 114/219
(58) Field of Search ..... 114/219, 220, 114/61.1; 405/211, 212, 215

(56) References Cited

U.S. PATENT DOCUMENTS

| | | | | | |
|---|---|---|---|---|---|
| 3,000,021 | A | * | 9/1961 | Lang | 114/219 |
| 3,988,997 | A | | 11/1976 | Fenton | 114/219 |
| 4,280,435 | A | * | 7/1981 | Loomis | 114/219 |
| 4,351,257 | A | | 9/1982 | Brown, Jr. | 114/219 |
| 4,628,850 | A | | 12/1986 | Day et al. | 114/219 |
| 4,738,215 | A | | 4/1988 | McMahon | 114/219 |
| 4,841,893 | A | | 6/1989 | Ellison | 114/219 |
| 4,893,576 | A | | 1/1990 | Day et al. | 114/219 |
| 4,895,094 | A | * | 1/1990 | Carlstedt | 114/218 |
| 5,299,521 | A | * | 4/1994 | Loucks | 114/219 |
| 5,355,822 | A | * | 10/1994 | Lemke | 114/219 |
| 5,697,316 | A | * | 12/1997 | Kinkead | 114/219 |
| 5,701,837 | A | * | 12/1997 | Harvey | 114/219 |
| 5,732,645 | A | * | 3/1998 | Lemke | 114/219 |
| 5,911,187 | A | * | 6/1999 | Sohm | 114/61.1 |
| 6,021,729 | A | * | 2/2000 | DeRuscio | 114/219 |
| 6,148,754 | A | | 11/2000 | Sims, Jr. | 114/219 |

* cited by examiner

*Primary Examiner*—Lars A. Olson
(74) *Attorney, Agent, or Firm*—Shook Hardy & Bacon LLP

(57) ABSTRACT

The present invention generally relates to a pontoon boat fender that is convenient to use, easy to install and easy to secure in place. The top end of the fender defines a channel that is sized to receive the top of the fence that surrounds the perimeter of the pontoon boat. A stretchable cord is coupled to the lower end of the fender body and to a suction device that is capable of coupling to the float tube of the boat. The fender body extends at least the length of the fence and is shaped so that when it is mounted to the top of the fence the fender does not rest against the remaining portion of the fence, the floor or the rub rail. With this shape, the fender is able to absorb impacts without transferring a significant amount of destructive energy to the pontoon boat components. Moreover, in one embodiment, the fender body includes a number of generally vertical channels that assist in absorbing any impact.

21 Claims, 1 Drawing Sheet

PONTOON BOAT FENDER

CROSS-REFERENCE TO RELATED APPLICATIONS

This application is a continuation of and claims priority pursuant to 35 U.S.C. Section 120 from U.S. application Ser. No. 29/170,816 filed Nov. 13, 2002 now U.S. Pat. No. Des. 481, 665.

STATEMENT REGARDING FEDERALLY SPONSORED RESEARCH OR DEVELOPMENT

Not applicable.

BACKGROUND OF THE INVENTION

The present invention relates generally to boating equipment. More particularly, the present invention provides a fender for a pontoon boat.

Boat fenders, which are often called bumpers, protect a boat from damage that might result from impact between the boat and a dock or another boat. Many types of fenders are available commercially, such as solid elastomeric fenders, which include extruded or molded rubber shapes, and low pressure fenders, which generally consist of an elastomeric skin filled with pressurized air or resilient foam. These fenders usually have eyelets or other means for suspending the fender from the superstructure of the boat between the boat and the dock or other structure. In operation, these fenders act to absorb impact forces but, unfortunately, often impart deflection and reactive forces upon the boat they are protecting.

In recent years, pontoon boats have become more common possibly because pontoon boats are both versatile and affordable. As with most boats, there is a concern that a pontoon boat, or a portion thereof, may be damaged as a result of impact with a dock, another boat or some other structure. Unfortunately, until recently, there have been no boat bumpers made specifically for pontoon boats.

A pontoon boat presents unique challenges to the fender designer. Typically, a pontoon boat has a pair of float tubes, a floor that rests on the float tubes and is surrounded by a rub rail, and a fence that is situated at the peripheral edge of the floor. The fence usually includes a frame made from a material such as corrugated steel that is not resistant to large impact forces. Often the floor, and consequently the fence, extends beyond the float tubes. Thus, if a pontoon boat collides with an object or structure, such as a dock, the impact will occur between the object and the fence and/or floor. Although a typical fender may absorb some of the energy caused by such an impact, the deflective and reactive forces imparted by the fender is often enough to damage the floor, the rub rail and, especially, the fence of the pontoon boat.

The present invention provides a fender that is designed to protect a pontoon boat. When mounted, the fender extends from the top of the fence to the top of the float tube. The fender is easy to mount and, once mounted, will stay in place. In addition, the fender is not restricted in where it may be mounted. Typical fenders require a cleat, a post or other structure to provide a place to tie a support rope. The fender of the present invention may be mounted at any location along the fence.

SUMMARY OF THE INVENTION

The present invention generally relates to a pontoon boat fender that is convenient to use, easy to install and easy to secure in place. The top end of the fender defines a channel that is sized to receive the top of the fence that surrounds the perimeter of the pontoon boat. Thereafter, the fender body extends at least the length of the fence and is shaped so that when it is mounted to the top of the fence the fender does not rest against the remaining portion of the fence, the floor or the rub rail. With this shape, the fender is able to absorb impacts without transferring a significant amount of destructive energy to the pontoon boat components. Moreover, in one embodiment, the fender body includes a number of generally vertical channels that assist in absorbing any impact. Finally, a stretchable cord is coupled to the lower end of the fender body and to a suction device that is capable of coupling to the float tube of the boat.

BRIEF DESCRIPTION OF THE SEVERAL VIEWS OF THE DRAWINGS

The present invention is described in detail below with reference to the attached drawing figures, wherein.

DETAILED DESCRIPTION OF THE INVENTION

The present invention provides a fender designed for use with a pontoon boat. The fender has means for mounting the fender to the fence surrounding the perimeter of the floor and means for securing the bumper in place. The fender further includes a body portion that is sized to extend the length of the fence and that is spaced away from the fence so that energy from an impact is absorbed without being transferred to the pontoon boat components, and specifically to the fence, floor and/or rub rail.

Figure 1:
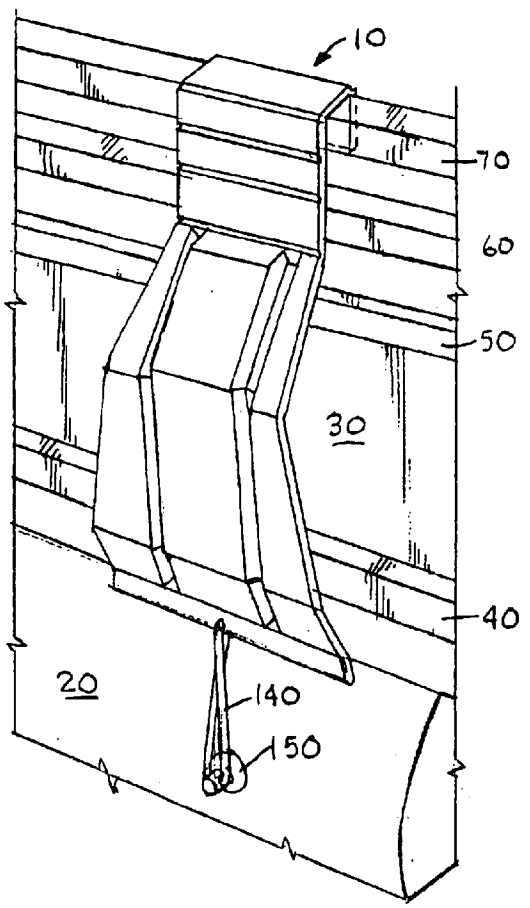
FIG. 1 is a front perspective view of a fender mounted to the fence rail of a pontoon boat according to one embodiment of the present invention.

A fender according to one embodiment of the present invention is shown in FIGS. 1–4 and is generally denominated by the numeral 10. In FIG. 1, fender 10 is mounted to a typical pontoon boat. The pontoon boat has a float tube 20 that is buoyant and, with at least one other float tube (not shown), supports the remaining components of the pontoon boat. The boat has a floor (not shown) resting atop the float tubes, which include tube 20. A fence 30 extends generally vertically around the periphery of the floor. Typically, fence 30 is manufactured from corrugated steel which is not very resistant to damage from impact forces. A rub rail 40, which is normally manufactured from stainless steel, is coupled to the floor and to the lower end of fence 30. A first fence rail 50 is coupled to the top end of fence 30. Two additional rails, second rail 60 and third rail 70, also are shown above first rail 50. Rub rail 40 and fence rails 50, 60, and 70 extend generally horizontally between and are coupled to a number of vertical fence posts (not shown).

Fender 10 is coupled at its upper end to third fence rail 70 and at its lower end to float tube 20 so that it extends at least the length of fence 30. As shown more specifically in FIG. 2, fender 10 includes a body portion that is directed first downwardly and outwardly away from the fence components and then downwardly and inwardly toward the float tube so that the body of fender 10 does not rest against the fence, rub rail or floor of the pontoon boat.

Figure 2:
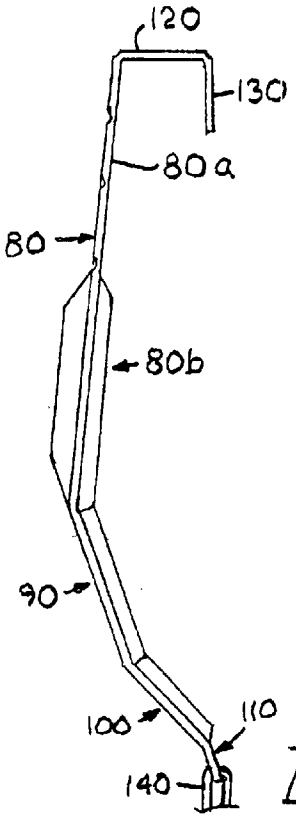
FIG. 2 is a side view of a fender according to one embodiment of the present invention.

Continuing with FIG. 2, this embodiment of fender 10 includes four body sections 80, 90, 100 and 110. First body section 80 extends downwardly and outwardly from a top rim section 120 to second body section 90 that extends downwardly and inwardly. Body section 80 may be divided further into section 80*a*, which has horizontal channels 160, and section 80*b*, which has vertical channels 170, as will be described below. Second body section 90 is followed by third body section 100 that also extends downwardly and inwardly, but at a slightly greater angle than second body section 90. Finally, fourth body section 110 extends downwardly and inwardly in a manner similar to second body section 90. The lower end of fourth body section 110 rests on top of float tube 20. It should be understood that the present invention is not limited to fenders that have four body sections and that the embodiment of the present invention that is shown in the figures is exemplary only.

As seen in FIG. 1, the top end of fender 10 is coupled to third fence rail 70. The portion of fender 10 that provides for this coupling includes first body section 80, top rim section 120 and flange section 130. First body section 80 extends downwardly from one end of top rim section 120 while flange section 130 extends downwardly from the other end. The length of top rim section 120 is approximately the width of fence rail 70 so that rail 70 fits snugly within the channel formed by body section 80, rim section 120 and flange section 130.

At the lower end of fender 10, a stretchable cord 140 runs through a hole formed in fourth body section 110 and through a suction cup device 150 that is coupled to float tube 20. Cord 140 and device 150 act to retain fender 10 to the pontoon boat while allowing fender 10 some freedom to move in response to movement of the pontoon boat. In other words, fender 10 may move slightly, for example, as the boat moves across the water or in response to the movement of the water. Cord 140, however, will cause fender 10 return to its original position and prevent fender 10 from being ejected from the boat. In a preferred embodiment, cord 140 is a ⅛-inch bungee cord.

As seen in the FIG. 1, fender 10 does not require a fence post or cleat in order to maintain its position. Thus, because it is coupled only to the top rail of fence 30 and to tube 20 as described above, fender 10 may be placed at any position around the periphery of the pontoon boat. This feature allows a boat owner or operator to move fender 10 to any place where an impact is likely without regard to other components of the boat.

Figure 3:
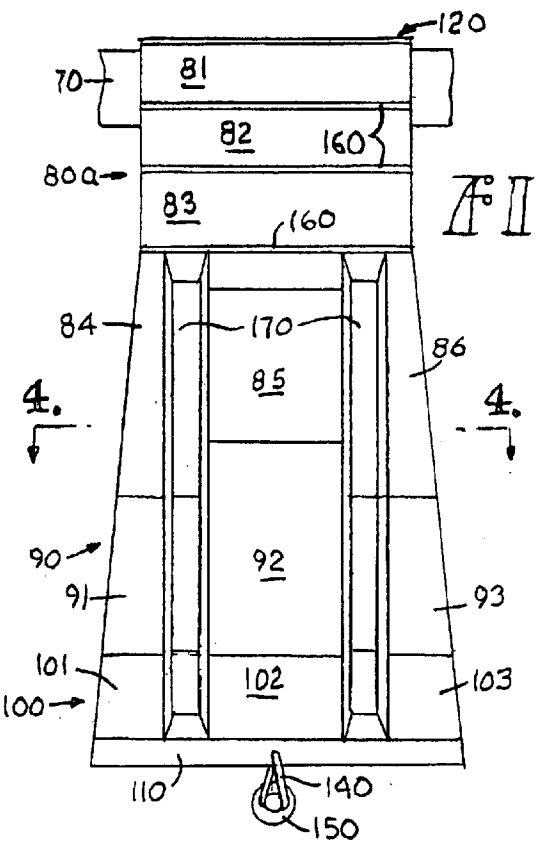
FIG. 3 is a front view of a fender according to one embodiment of the present invention.

Referring additionally to FIG. 3, in this embodiment, three horizontal channels 160 extend across the front side of body section 80*a*. Channels 160 divide body section 80*a* into three panels, a first panel 81, a second panel 82 and a third panel 83. Two vertical channels 170 extend along the front sides of body sections 80*b*, 90 and 100. Vertical channels 170 divide section 80*a* into three portions 84, 85 and 86, section 90 into three portions 91, 92 and 93, and section 100 into three portions 101, 102 and 103.

Figure 4:
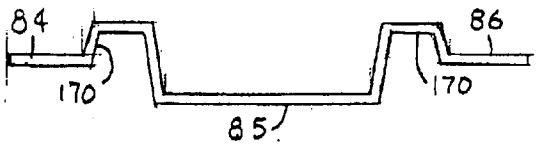
FIG. 4 is a top sectional view of the fender of FIG. 3 taken along line 4—4.

FIG. 4 show a sectional view of fender 10. From this figure, it is apparent that portions 84, 85 and 86 define channels 170 so that the surface of portion 85 is positioned forward of the surfaces of portions 84 and 86. Thus, if an object impacts upon body portion 80*b* of fender 10 from most forward angles, the object will come into contact with portion 85 instead of portions 84 and 86. When this occurs, the presence and shape of channels 170 within portion 80*b* (and likewise to portions 90 and 100) provides additional strength to portion 80*b* to further enhance portion 80*b*'s ability to withstand the impact and to dissipate the resulting stresses without harming the floor, fence and rub rail of the pontoon boat.

In a preferred embodiment, fender 10 is manufactured from high density polyethylene, although it may also be manufactured from a number of solid plastics or vinyl, such as polyvinyl chloride, or other suitable material. Additionally, fender 10 is solid so that the user is not required to pump air or liquid into the fender prior to use or periodically during use.

In operation, a user will determine the most likely place or places that an object, such as a dock, may impact on his or her pontoon boat. The user will then position fender 10 at that location by first sliding the top part of fender 10 over the top rail 70 of the fence 30 so that top rail 70 is receiving within the channel formed by section 80*a*, top rim 120 and flange 130. The user will then place the bottom edge of section 110 on float tube 20. Thereafter, the user will attach suction device 150 to float tube 20 so that cord 140 is stretched to the extend desired by the user. The user, for example, may attach suction device 150 some distance below fender 10 so that cord 140 is tightly stretched which will cause fender 10 to remain in its original position in all cases. Alternatively, the user may attach suction device 150 closer to fender 10 so that cord 140 is not as tightly stretched which will allow fender 10 some freedom to move from its original position.

When an object impacts on fender 10, the impact energy is spread through the body of fender 10 and substantially withheld from the pontoon boat components. The impact may cause fender 10 to deflect towards the pontoon boat but, because fender 10 is spaced apart from the boat components, such as the floor, rim rail and fence, fender 10 will not itself impact on these components so long as the act of deflecting the impact dissipates the impact energy. Thus, the deflection will not harm these components. Obviously, some impacts may be so large that no fender or bumper may protect the boat. Additionally, channels 170 act to strengthen fender 10 and help fender 10 to absorb and dissipate greater impact energy.

While a particular embodiment of the invention has been illustrated and described in detail herein, it should be understood that various changes and modifications might be made to the invention without departing from the scope and intent of the invention. The embodiment described herein is intended in all respects to be illustrative rather than restrictive. Alternate embodiments will become apparent to those skilled in the art to which the present invention pertains without departing from its scope. Moreover, from the foregoing it will be seen that this invention is one well adapted to attain all the ends and objects discussed, together with other advantages, which are obvious and inherent to the device.

The invention claimed is:

1. A fender for protecting a pontoon boat, said pontoon boat comprising at least two float tubes supporting a floor and a fence positioned around the periphery of said floor, said fence having a generally vertical main part and a generally horizontally extending rail that is coupled to the top of said fence main part, said fender comprising:

a body portion, said body portion having a top part that extends generally downwardly and outwardly from said fence rail and a bottom part that extends generally downwardly and inwardly to said float tube, said bottom part including a first part that extends downwardly and inwardly at a first angle and a second part that extends downwardly and inwardly at a second angle and wherein said first angle is less than said second angle;

a top rim that extends generally horizontally from said top part of said body portion and ends at a flange that extends generally downwardly thereby forming a channel for receiving said fence rail; and means for removably coupling said bottom part of said body portion to one of said float tubes.

2. The fender of claim 1, further comprising at least one channel extending generally vertically along at least a portion of the length of said body portion.

3. A fender for protecting a pontoon boat, said pontoon boat comprising at least two float tubes supporting a floor and a fence positioned around the periphery of said floor, said fence having a generally horizontally extending rail spaced from the floor, said fender comprising:

a body portion, said body portion having a top part that extends generally downwardly and outwardly from said fence rail and a bottom part that extends generally downwardly and inwardly towards said float tube, wherein at least one channel extends generally vertically along at least part of the length of said body portion; and a top rim formed atop said body portion with at least a section thereof extending generally inwardly to overlie and contact said generally horizontally extending rail of said fence.

4. The fender of claim 3, wherein said at least one channel extends through a transition between said top part and said bottom part of said body portion.

5. The fender of claim 3, further comprising a means for removably coupling said body portion to said pontoon boat.

6. The fender of claim 5, wherein said means for removably coupling said body portion to said pontoon boat includes a flexible member that is adapted to be secured with said body portion and said pontoon boat.

7. A fender for protecting a pontoon boat, said pontoon boat comprising at least two float tubes supporting a floor and a fence positioned around the periphery of said floor, said fence having a generally horizontally extending rail spaced from the floor, said fender comprising:

a body portion, said body portion having a top part that extends generally downwardly and outwardly from said fence rail and a bottom part that extends generally downwardly and inwardly towards said float tube;

a top rim formed atop said body portion with at least a section thereof extending generally inwardly to overlie said generally horizontally extending rail of said fence; and means for removably coupling said body portion to said pontoon boat;

wherein said top rim is adapted to support at least a portion of the weight of said fender on said generally horizontally extending rail.

8. The fender of claim 7, further comprising at least one channel extending generally vertically along at least part of the length of said body portion.

9. The fender of claim 8, wherein said at least one channel extends generally vertically for a substantial distance along the length of said body portion.

10. The fender of claim 8, wherein said at least one channel extends generally vertically for a substantial distance along one or more sections of said body portion.

11. The fender of claim 8, wherein said at least one channel faces outwardly with respect to said pontoon boat.

12. The fender of claim 8, wherein said at least one channel extends through a transition between said top part and said bottom part of said body portion.

13. The fender of claim 7, wherein said means for removably coupling said body portion to said pontoon boat includes a flexible member that is adapted to be secured with said body portion and said pontoon boat.

14. The fender of claim 13, wherein said flexible member is a stretchable cord.

15. A fender for protecting a pontoon boat, said pontoon boat comprising at least two float tubes supporting a floor and a fence positioned around the periphery of said floor, said fence having a generally horizontally extending rail spaced from the floor, said fender comprising:

a body portion, said body portion having a top part that extends generally downwardly and outwardly from said fence rail and a bottom part that extends generally downwardly and inwardly towards said float tube, wherein at least one channel extends generally vertically along at least part of the length of said body portion;

a top rim formed atop said body portion with at least a section thereof extending generally inwardly to overlie and contact said generally horizontally extending rail of said fence; and means for removably coupling said body portion to said pontoon boat.

16. The fender of claim 15, wherein said at least one channel extends generally vertically for a substantial distance along the length of said body portion.

17. The fender of claim 15, wherein said at least one channel extends generally vertically for a substantial distance along one or more sections of said body portion.

18. The fender of claim 15, wherein said at least one channel faces outwardly with respect to said pontoon boat.

19. The fender of claim 15, wherein said at least one channel extends through a transition between said top part and said bottom part of said body portion.

20. The fender of cairn 15, wherein said means for removably coupling said body portion to said pontoon boat includes a flexible member that is adapted to be secured with said body portion and said pontoon boat.

21. The fender of claim 20, wherein said flexible member is a stretchable cord.

* * * * *